US005162856A

United States Patent [19]

Hayashida et al.

[11] Patent Number: 5,162,856

[45] Date of Patent: Nov. 10, 1992

[54] ABRASIVE, POLISHING AND FRICTION-REDUCING AGENT AND MEANS FOR APPLYING THE AGENT ON AN IMAGE CARRIER OF AN IMAGE FORMING APPARATUS

[75] Inventors: Masatoshi Hayashida, Kawasaki; Hirofumi Izaki, Tokyo, both of Japan

[73] Assignee: Kabushiki Kaisha Toshiba, Kawasaki, Japan

[21] Appl. No.: 686,512

[22] Filed: Apr. 17, 1991

[30] Foreign Application Priority Data

Apr. 19, 1990 [JP] Japan ..... 2-103378

[51] Int. Cl.[5] ..... G03G 21/00

[52] U.S. Cl. ..... 355/296; 15/256.51; 51/293; 51/309

[58] Field of Search ..... 355/296, 297, 299, 304, 355/306; 51/293, 294, 309; 118/652; 15/256.51; 430/125; 222/189; 209/417, 235, 680

[56] References Cited

U.S. PATENT DOCUMENTS

| | | | |
|---|---|---|---|
| 3,013,703 | 12/1961 | Hunt | 222/DIG. 1 |
| 3,488,896 | 1/1970 | Makino et al. | 355/307 X |
| 3,552,850 | 1/1971 | Royka et al. | 15/256.51 X |
| 3,900,588 | 8/1975 | Fisher | 430/125 |
| 4,076,564 | 2/1978 | Fisher | 355/299 X |
| 4,279,500 | 7/1981 | Kondo et al. | 118/652 X |
| 4,364,329 | 12/1982 | Murai et al. | 118/652 |
| 4,870,465 | 9/1989 | Lindblad et al. | 355/296 |
| 4,954,140 | 9/1990 | Kawashima et al. | 51/293 X |
| 5,011,511 | 4/1991 | Beck | 51/295 |

FOREIGN PATENT DOCUMENTS

| | | | |
|---|---|---|---|
| 0101177 | 8/1981 | Japan . | |
| 0064277 | 4/1982 | Japan . | |
| 57-144542 | 9/1982 | Japan . | |
| 0136075 | 8/1983 | Japan . | |
| 0009379 | 1/1987 | Japan . | |
| 0151982 | 6/1988 | Japan | 355/297 |
| 1198784 | 8/1989 | Japan | 355/296 |
| 0179049 | 5/1922 | United Kingdom | 51/294 |

*Primary Examiner*—Richard L. Moses
*Assistant Examiner*—Matthew S. Smith
*Attorney, Agent, or Firm*—Foley & Lardner

[57] ABSTRACT

A lubricant for reducing friction produced between a cleaning device and a photoconductor both assembled in a copying apparatus includes an abrasive agent having an average grain diameter of 0.5 μm to 9.0 μm. The abrasive agent comprises a main chemical component of material which does not change the developing characteristics of a developer used in an electrostatic copying process and which refines the scratches produced on the surface of the photoconductor due to the contact between the developer and the photoconductor during a long period of time.

10 Claims, 5 Drawing Sheets

ABRASIVE, POLISHING AND FRICTION-REDUCING AGENT AND MEANS FOR APPLYING THE AGENT ON AN IMAGE CARRIER OF AN IMAGE FORMING APPARATUS

BACKGROUND OF THE INVENTION

1. Field of the Invention

This invention relates to a lubricant for an image forming apparatus and more specifically for an image carrier assembled into an image forming apparatus.

2. Description of the Related Art

In general, image forming apparatus such as a copying machine, which uses the electrostatic copying process or an electrophotographic process, includes an image reading section for illuminating a document with light and leading the reflected light to an image carrier, an image forming section having the image carrier on which electrostatic latent images are formed by the reflected light emitted from the image reading section and then images on the document are reproduced, and a material delivering section for supplying material such as plain paper sheets or O.H.P. sheets to the image forming section and for taking out the material on which the images reproduced by the image forming section are transferred.

The image reading section has a document table on which a document is mounted, an illuminating device for illuminating the document and an optical unit for guiding the reflected light from the document.

The image forming section includes an image carrier or a photoconductor for successively forming electrostatic latent images corresponding to the reflected light coming from the reading section, a charging device for supplying electric charges having required polarities to the photoconductor, a developing device for supplying developing agents or toner to the electrostatic latent images to visualize the images, a transferring unit for transferring the developed images to a paper sheet, a fixing unit for melting the toner and fixing them to the paper sheet, and a cleaning unit having an elastic blade and pressed on the outer peripheral surface of the photoconductor under a prescribed pressure and an eraser device, for returning the electric charge distribution to the initial state and for removing the images as well as the toner thereon left on the surface of the photoconductor.

The material delivering section has paper cassettes for supplying paper sheets on which images are to be transferred, a paper feeder for feeding the paper sheets to the image forming section, and an output unit for delivering the image-transferred paper sheets outside of the copying machine.

When the copying machine is first used after it has been manufactured, the cleaning unit is generally processed by means of so-called setting-up process which is intended to reduce friction between the elastic blade and the photoconductor by coating them with a solid lubricant such as vinylidene trifluoride.

The reduction of the friction between the photoconductor and the blade by the use of the lubricant can prevent the breakage of the blade.

The published unexamine Japanese Patent Application 57-144542 which was filed on Sep. 7, 1982 discloses a solid lubricant of this kind.

When, however, the friction between the blade and the photoconductor is large, the use of the lubricant disclosed in mention above patent application cannot always prevent the blade from being broken. The use of a lot of lubricant allows the lubricant to be mixed with the developer for developing the latent images so that the developing characteristics such as the condensation of the developer are apt to be changed during a long period of time.

Further, a lot of lubricant mixed with the developer likely damages the surface of the photoconductor.

SUMMARY OF THE INVENTION

An object of this invention is to provide a lubricant which reduces friction between a photoconductor and a cleaning blade pressed against the photoconductor under a relatively large pressure.

Another object of this invention is to provide a lubricant which does not change the characteristics of a developer for developing latent images formed on a photoconductor.

A further object of this invention is to provide a lubricant which polishes the surface of a photoconductor from fine scratches otherwise produced on the surface of the photoconductor due to the contact between the photoconductor and blades or between the photoconductor and material to which latent images are transferred from the photoconductor during a long period of time.

This invention provides an abrasive agent adapted for an image forming apparatus having an image carrier and removing means for removing a developing agent remaining on the image carrier therefrom by contact with the image carrier and for reducing a friction generated by contact of the removing means with the image carrier, comprising:

an abrasive powder having an average powder size falling within a range of about 0.5 μm to 9.0 μm; and a plastic powder having an average powder size larger than the average powder size of the abrasive powder.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
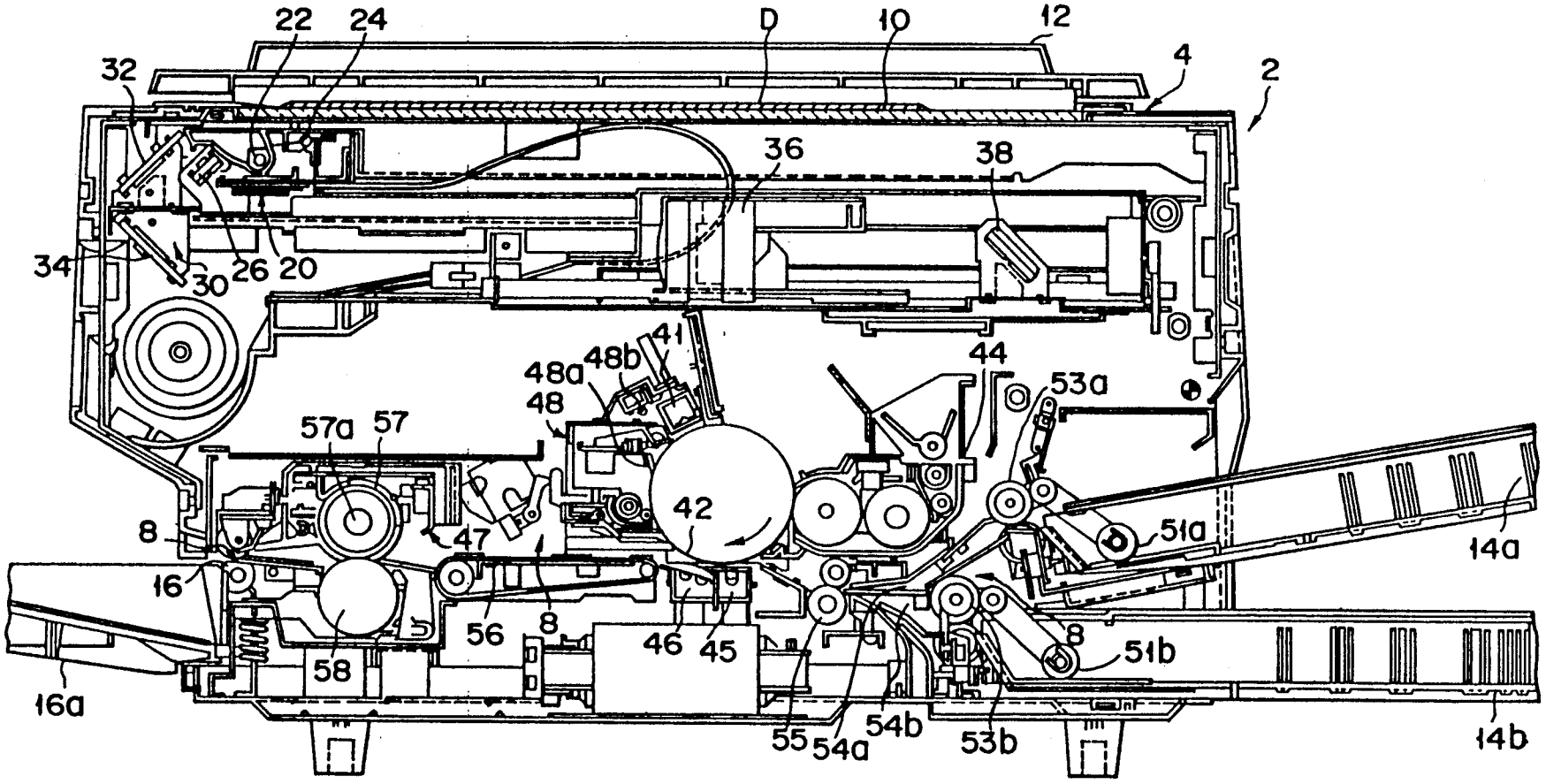
FIG. 1 is a cross-sectional view of an image forming apparatus having a cleaning device in which an embodiment of a lubricant according to this invention.

As shown in FIG. 1, an image forming machine has a document table 10, for optically reading information on a document D mounted on the document table 10 as bright and dark light patterns, an image forming section 6 for forming images corresponding to the light patterns supplied from the reading section 4, and a material delivering section 8 for supplying material or paper sheets P to the image forming section 6 and delivering, outside of the machine 2, the paper sheets P on which the images are transferred by means of the image forming section 6.

Within the copying machine 2 under the document table 10 are provided, a first carriage 20 having a lamp 22 extending in a first direction or a main scanning direction, for illuminating the document D, a reflector 24 extending in the main scanning direction as the lamp 22, for converging light beams from the lamp 22 on the document D, and a primary mirror 26 extending in the main scanning direction as the lamp 22, for leading the reflected light from the document D to the image forming section 6, a second carriage 30 including a secondary mirror 32 and a tertiary mirror 34 both extending in the main scanning direction, for bending the optical path of the reflected light traveling toward the image forming section 6, a lens 36 for converging the reflected light traveling from the primary mirror 26 to the image forming section 6, and a folding mirror 38 extending in the main scanning direction as the first and second carriers 20 and 30, for guiding the reflected light passing through the lens 36 toward an image carrier (mention later), the folding mirror 38 being adapted to being movable by means of a lens motor (not shown) so as to move the lens 36 and adjust the distance between the rear-focal plane of the lens 36 and the surface of the image carrier.

The reflected light passing through the lens 36 traveling through the central portion of the machine 2 is focused on the image carrier or a photoconductor 42 continuously movable in the direction perpendicular to the main scanning direction or in a sub-scanning direction.

The photoconductor 42, includes a hollow cylindrical member made of materials such as aluminum, and a thin layer formed on the outer peripheral surface and having a thickness of approximately 100 μm or less and fcrmed by an inorganic-chemical photosensitive material such as Se, CdS, Si or a-Si or an organic-chemical photosensitive material such as PVK or 247-TNF.

A charging device 41 for giving the photoconductor 42 required charges, a developing device 44 for supplying, to the photoconductor 42, toner for developing the latent images formed on the photoconductor 42 to develop the latent images, a transferring device 45 for transferring the developed images developed by the developing device 44 to the paper sheet P supplied by the material delivering section 8, an AC charging unit 46 for generating an AC voltage for separating, from the photoconductor 42, the paper sheet P on which the developed images are formed by the toner; and a cleaning unit 48 having an elastic blade 48*a* pressed against the outer peripheral surface of the photoconductor 42 at required angles and an erasor device 48*b*, for removing the toner left on the surface of the photoconductor and returning the distribution pattern of electric charges to the original state, respectively, are arranged around the photoconductor 42.

At the right side of the image forming section 6 are arranged an upper paper cassette 14*a* and a lower paper cassette 14*b* which form part of the material delivering section 8 and from which different sizes of paper sheets P are selectively delivered to the image forming section 6.

The material delivering section 8 has two paper-feeding rollers 51*a* and 51*b*, friction roller 52, two pairs of paper-transferring rollers 53*a* and 53*b*, two pairs of paper-transferring paths 54*a* and 54*b*, and a timing roller 55. The first paper-feeding roller 51*a* is located between the image forming section 6 and the first paper cassette 14*a*, for feeding the paper sheets P, piece by piece, from the cassette 14*a* toward the section 6. The second paper-feeding roller 51*b* is located between the image forming section 6 and the second paper cassette 14*b*, for feeding the paper sheets P, piece by piece, from the cassette 14*b* toward the section 6. The first paper-transferring roller 53*a* is provided between the first paper-feeding roller 51*a* and the photoconductor 42, for transferring the paper sheets P, piece by piece, from the roller 51*a* toward the photoconductor 42. Similarly, the second paper-transferring roller 53*b* is provided between the second paper-feeding roller 51*a* and the photoconductor 42, for transferring the paper sheets P, piece by piece, from the roller 51*b* toward the photoconductor 42. Both paper-transferring paths 54*a* and 54*b* are made of a guide plate each. The first path 54*a* guides each paper sheet P from the roller 53*a* to the timing roller 55, whereas the second path 54*a* guides each paper sheet P from the roller 53*b* to the timing roller 55. The timing roller 55 corrects the inclination of each paper P reaching it, and the front edge of the sheet P is aligned with the front side of the toner image formed on the photoconductor 42.

A fixing unit 47 and a paper transporter 56 are located on the left side of the photoconductor 42. The transporter 56 is provided between the image forming section 6 and the fixing unit 47. The device 56 has a plurality of endless belts. When driven by a drive unit (not shown), these endless belts transfer a paper sheet P from the image forming section into the gap between the heater roller 57 and press roller 58 of the fixing unit 47. The fixing unit 47 includes a heater roller 57 and a press roller 58, which extend parallel to each other. The heater roller 57 is a hollow cylinder and contains a heater lamp 57*a*. The roller 57 applies heat to the paper sheet P passing through the gap between it and the press roller 58, whereas the press roller 58 applies pressure to the paper sheet P. The heat melts the toner (defining the image), whereby the image is fixed on the paper sheet P.

An exit rollers 16 are used to deliver the paper sheet P, which has been image-fixed by the fixing unit 47, from the housing of the copying machine 2 onto the tray 16*a* which is secured to the side of the housing, which opposes the side on which the cassettes 14*a* and 14*b* are provided. A tray 16*a* receives and hold the copied sheets P, one upon another.

Figure 2A:
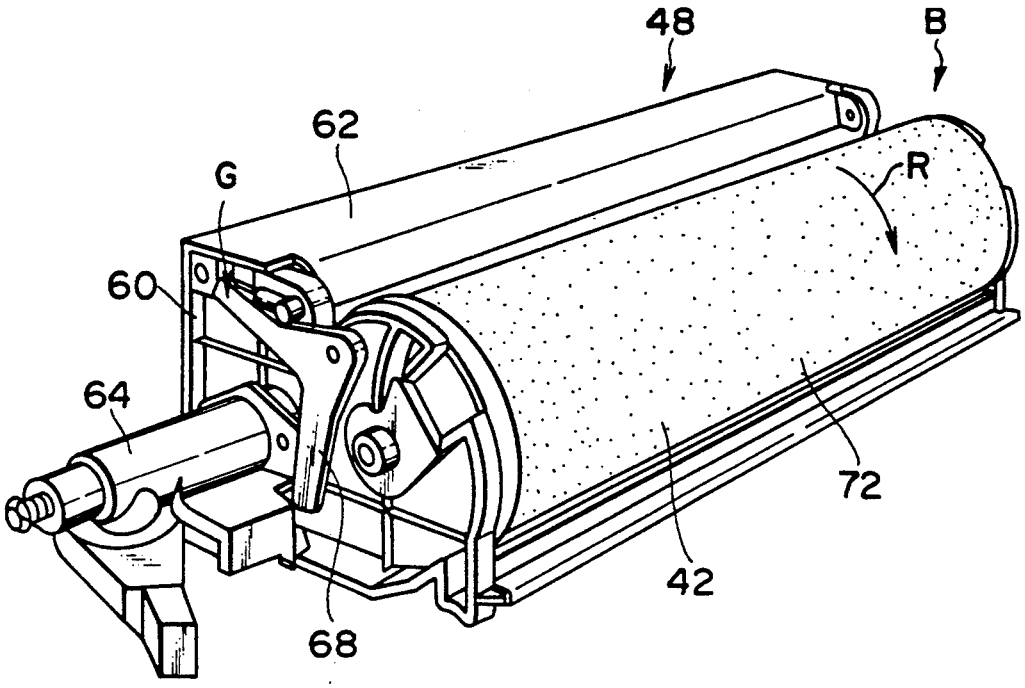
FIG. 2A is a perspective view of the cleaning device assembled in the image forming apparatus shown in FIG. 1.
Figure 2B:
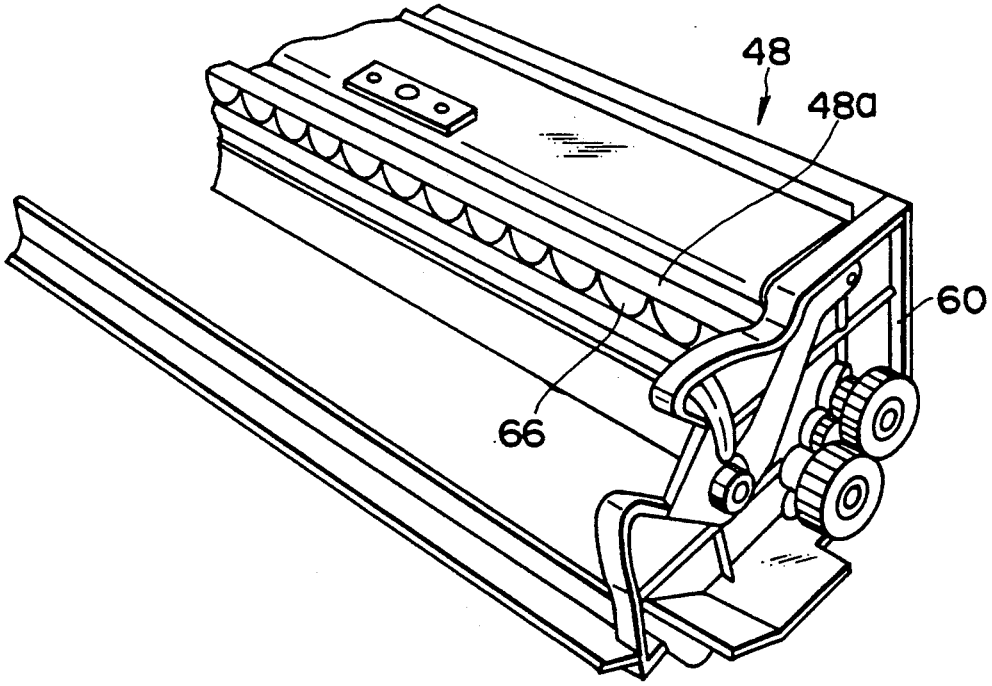
FIG. 2B is a perspective view of the cleaning device shown in FIG. 2A, as seen from the side B in FIG. 2A.

As shown in FIGS. 2A and 2B, the cleaning unit 48 includes cleaning unit body 60 extending in the main scanning direction and containing the photoconductor 42. The unit body 60 has a blade 48*a* which is arranged in substantial parallel with the main scanning direction and which extends perpendicularly to the rotational direction of the photoconductor 42 so that it is selectively contacted with or removed from the photoconductor 42. Under the toner cover 62 of the unit body 60 is positioned a screw roller 66 for transporting the toner scraped off from the photoconductor 42 by means of the blade 48*a* to a toner exhaust portion 64.

When the copying machine 2 is first used after it has been manufactured, that is, at the time of setting-up, as already explained in the description of the related art, the whole area of the peripheral surface of the photoconductor 42 is substantially uniformly coated with a lubricant 70 for reducing the friction between the photoconductor 42 and the blade 48*a*, the process being hereinafter called the setting-up process.

Figure 3:
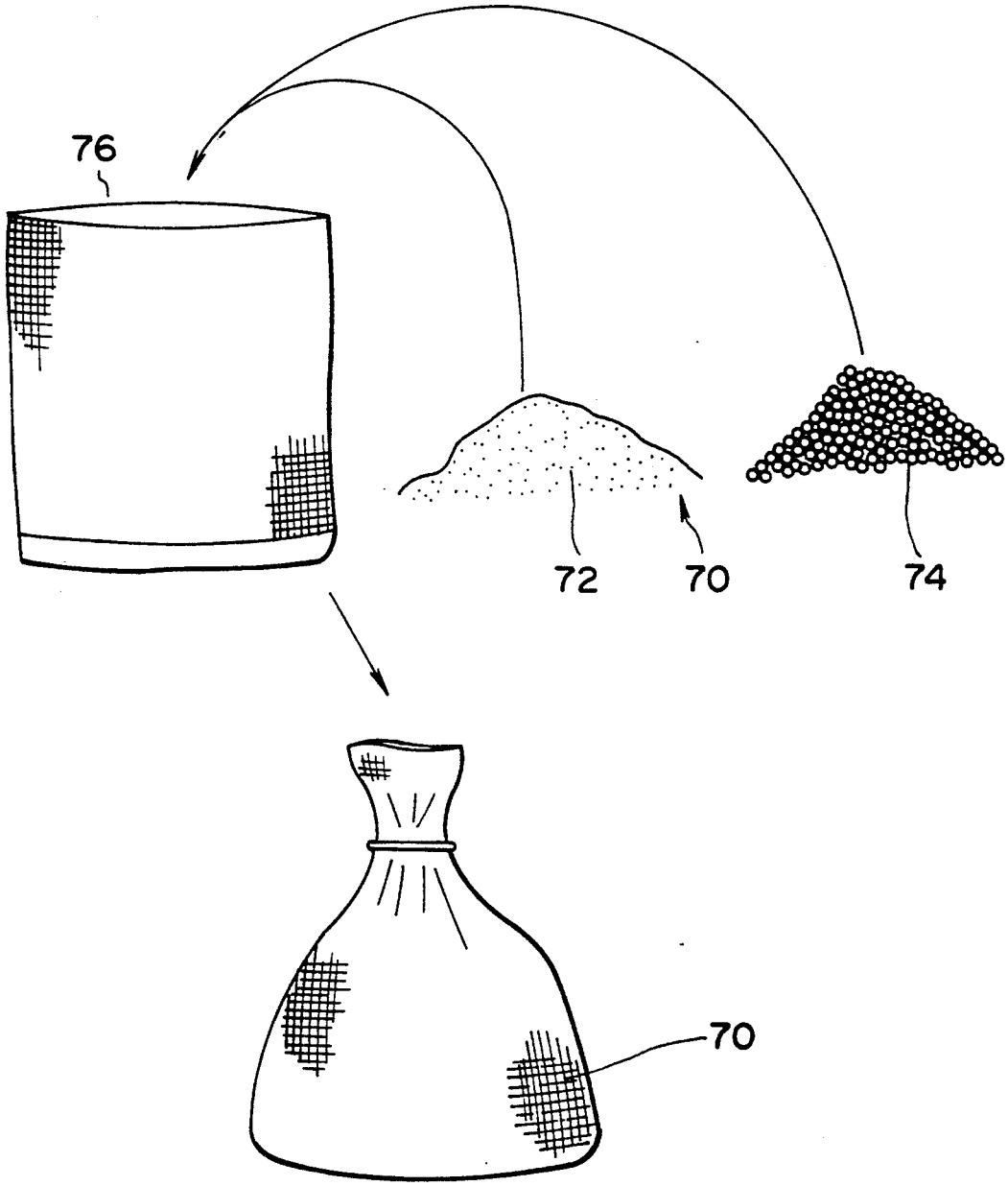
FIG. 3 illustrates how to produce a lubricant used in the cleaning device shown in FIGS. 2A and 2B.

As shown in FIG. 3, the lubricant 70 includes abrasive grains 72 having an average diameter of 0.5 μm to 9.0 μm and made of a material having a relatively high hardness such as alumina, emery, zirconia, silicon carbide, or cerium, is mixed with plastic grains 74 at a required ratio. The plastic grains 74 are mixed with the abrasive grains 72 so that the latter ones prevent the former ones from being adhered to each other and allow the latter ones to uniformly cover the photoconductor 42.

Figure 4A:
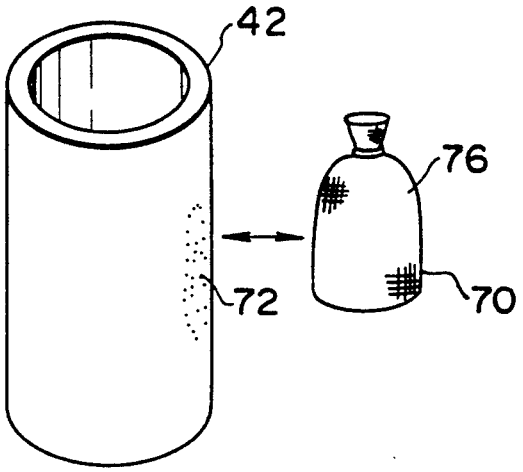
FIGS. 4A and 4B respectively show how to sprink the lubricant of FIG. 3 on a photoconductor.
Figure 4B:
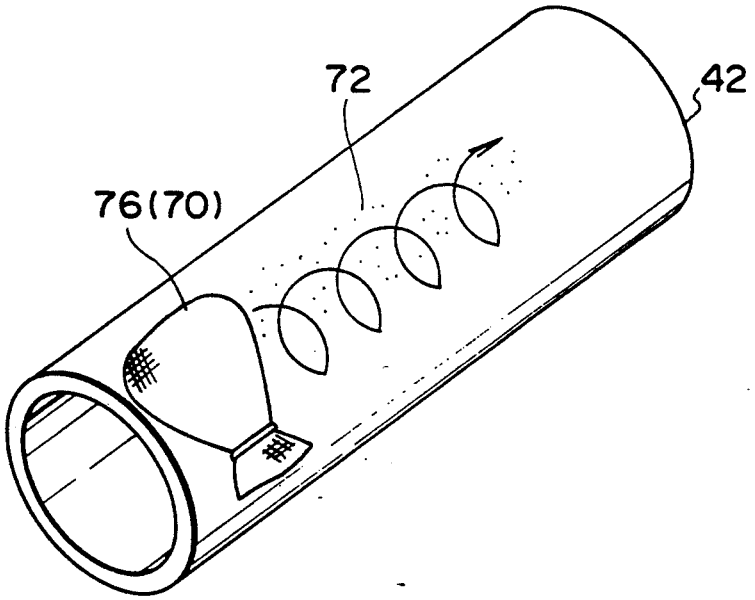

As shown in FIGS. 4A and 4B, the lubricant 70 is put in a coth bag 76 (shown in FIG. 3) having relatively large meshes and the photoconductor 42 is manually covered with it by a serviceman or a user. In other words, the photoconductor 42 is uniformly covered with the outer peripheral surface of the lubricant 70 by patting the outer peripheral surface of the photoconductor 42 lightly with the cloth bag 76 as shown in FIG. 4A or by rubbing the outer peripheral surface of the photoconductor 42 lightly with the cloth bag 76 as shown in FIG. 4B. In doing so, the photoconductor 42 is removed from the unit body 60. Therefore, extreme care is taken so that scratches are not produced on photoconductor 42, or dirt does not adhere to the outer peripheral surface of the photoconductor 42. The outer peripheral surface of the photoconductor 42 is fully shielded from light beams so that it is not illuminated with them. The cloth bag 76 has such meshes that the abrasive grains 72 smoothly pass through the meshes but the plastic grains do not flow out therethrough.

After being uniformly covered with the lubricant 70, the photoconductor 42 is mounted in the unit body 60. By pushing down a lever 68 in the direction of an arrow G (shown in FIG. 2A), the blade 48*a* is pressed against the outer peripheral surface of the photoconductor 42. As shown in FIG. 2A, the photoconductor 42 is rotated in the direction of an arrow R in a state in which the blade 48*a* is pressed against the photoconductor 42. Since the lubricant 70 is distributed between the blade 48*a* and the photoconductor 42 in this case, the photoconductor 42 is rotated smoothly without removing the blade 48*a* or scratching the outer peripheral surface of the photoconductor 42. In other words, when the blade 48*a* contacts the outer peripheral surface of the photoconductor 42 which generally constitutes a mirror surface, the friction which is otherwise large is greatly reduced by the lubricant 70 with which the photoconductor 42 is covered so that the setting-up process is smoothly carried out without damage to the photoconductor 42 and the blade 48*a*.

The lubricant 70 containing abrasive grains 72, such as alumina, emery, zirconia, silicon carbide or cerium gives smaller effects to the developing characteristics due to the developer (carrier and toner), such as the condensation of the developer and variation of the amounts of charges produced by the mixing of the carrier with the toner than the conventional lubricant such as vinylidene trifluoride. The conventional lubricant is intended to reduce the friction between the photoconductor 42 and the blade 48*a*. However, since the main component is an abrasive agent, the lubricant of this invention prevents scratches which are otherwise likely to be produced on the outer peripheral surface of the photoconductor 42, as the total copying volume produced by the copying machine 2 is increased. This enhances the copying ability (wear resistance or life) of the outer periphery surface of the photoconductor 42.

Figure 5:
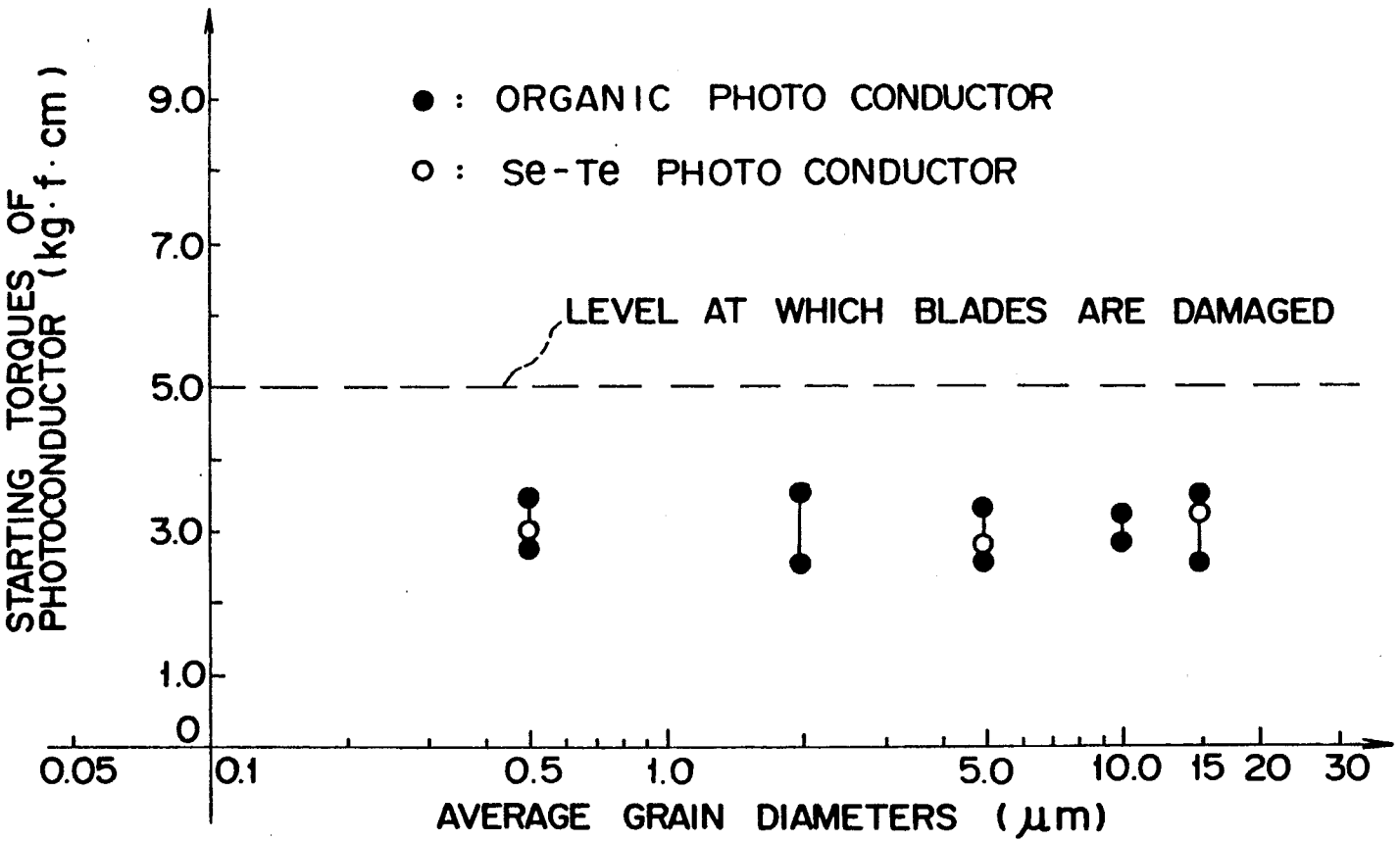
FIG. 5 is a graph showing the relations between the grain sizes of abrasive grains included in a lubricant of this invention and the frictional forces thereof.

Referring to FIG. 5 and Table 1, experimental results will now be explained in detail in which, when the lubricant 70 was used, the variation of the friction was considered to be the variation of the starting torques required for rotating the photoconductor 42.

TABLE 1

| | Starting Torques (Kgfcm) | Rate of Damaging Blades (%) |
|---|---|---|
| No Lubricant | 6.0 to 10.0 | All Samples |
| Conventional Lubricant, | 4.0 to 8.0 | 40 |
| Lubricant of This Invention | 2.0 to 4.0 | 0 |

The starting torques are determined by a plurality of parameters such as the size of the photoconductor 42 (the maximum copying size), the angle at which the blade 48*a* contact the photoconductor 42 and the elastic coefficient of the blade 48*a*. In this respect, it is generally difficult to specify the value of the starting torque at which the blade is not damaged. In the case of this experiment, however, it was confirmed that the blades were heavily damaged when the starting torque exceeded approximately 5.0 Kgfcm.

As apparent from Table 1, it is observed that all samples were damaged when the photoconductor 42 was not covered with a lubricant. The use of the conventional lubricant reduced the breakage of the blade 48*a* but it could not prevent their breakage completely. On the other hand, the lubricant 70 of this invention entirely prevented the breakage of the blade 48*a*.

FIG. 5 shows how the friction changes according to the different grain diameters of the abrasive grains 72 included in the lubricant 70, in which it is noted that friction was sufficiently reduced when any lubricants 70 including the abrasive grains 72 having average grain diameter of 0.5, 2.0, 5.0, 10.0 and 15.0 μm were used. It is confirmed, however, that visible scratches extending in the direction of rotation of the photoconductor 42 were apt to be produced thereon when the grain diameter was over 10.0 μm. Since these scratches deteriorates the wear resistance of the photoconductor 42, i.e., shortens its life, it is preferred that the grain diameter of the abrasive grains 72 should be less than 10 μm.

The operation of the copying machine 2 shown in FIG. 1 will now be outlined.

The document D is mounted on the document table 10 and is closely contacted therewith by closing the document cover 12. The document D is illuminated by the lamp 22 and the reflector 24. The light reflected by the document D are led to the primary mirror 26 and reflected thereby to the secondary mirror 32. The light led to the secondary mirror 24 is turned through 90° and guided to the tertiary mirror 34. The light is again reflected by the tertiary mirror 34 through 90° and directed to the lens 36.

The light which passed through the lens 36 is further reflected by the folding mirror 38 and form images at the required position.

The first and second carriages 20 and 30 are reciprocatingly moved by means of pulse motor (not shown) at a required speed corresponding to the copying magnification in the sub-scanning directions. The lamp 22 is turned on only when the document D is being read, that is, when the lamp 22 is moved in the forward direction.

Simultaneously with the sub-scanning by the first and second carriages 20 and 30, the photoconductor 42 is continuously rotated, so that the images of the document D are transferred and converted into electrostatic latent images in succession. The developing device 44 supplies the toner to the latent images and develops them.

As the photoconductor 42 is rotated, the images developed by the toner are moved to be transcribed to the paper sheet P which has been transferred by either one of the cassettes 14*a* and 14*b*. The paper sheet P to which the toner has been transferred is separated from the photoconductor 42 by means of AC charges supplied from the AC charging device 46 and sent to the fixing unit 47, that is, to a pressure area between the heater roller 57 and the press roller 58 by means of the transferring device 56.

The toner is heated at approximately 180° C. by means of the heater roller 57 so as to be fused and is fixed to the paper sheet P to which the toner has been transcribed.

The paper sheet P fixed by the toner is delivered outside of the copying machine 2 and held in the tray 16*a*.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An abrasive agent and means for applying the abrasive agent on an image carrier of an image forming apparatus, said means for applying the abrasive agent comprising a housing, the abrasive agent being provided in the housing for use in the image forming apparatus having an image carrier and removing means for removing a developing agent remaining on the image carrier by contact with the image carrier and for reducing friction created by contact between the removing means and the image carrier, the abrasive agent comprising a particulate mixture of abrasive powders having an average diameter between about 0.5 μm -9.0 μm an containing at least one abrasive powder made from a material selected from the group consisting of alumina, emery, zirconia, silicon carbide and cerium, said abrasive powders being provided independently of the developing agent, and plastic powders having an average diameter larger than the average diameter of the abrasive powders;

the housing having mesh elements for allowing the abrasive powders to pass therethrough and for preventing the plastic powders from passing therethrough.

2. An abrasive agent according to claim 1, wherein said abrasive powders are supplied to the image carrier while passing through the mesh elements.

3. An abrasive agent according to claim 1, wherein said abrasive powders are supplied to the image carrier while passing through the mesh elements, when the removing means is brought into initial contact with the image carrier.

4. An abrasive agent according to claim 1, wherein said abrasive powders are supplied to the image carrier while passing through the mesh elements, when said image carrier is scratched during printing.

5. An abrasive agent according to claim 1, wherein said abrasive powders are supplied to the image carrier while passing through the mesh elements, when printing is effected by a predetermined number of times.

6. An abrasive agent and means for applying the abrasive agent on an image carrier of an image forming apparatus, said means for applying the abrasive agent comprising a housing, said abrasive agent being contained in said housing, said abrasive agent being adapted for use in a printer apparatus having an image carrier and comprising a particulate mixture of:

(a) abrasive powders having an average diameter falling with a range of about 0.5 μm -9.0 μm and containing at least one abrasive powder made from a material selected from the group consisting of alumina, emery, zirconia, silicon carbide and cerium; and (b) plastic powders consisting essentially of spherical particles having an average diameter larger than the average diameter of the abrasive powders, (c) said housing having a mesh for allowing only said abrasive powders to pass therethrough, (d) said abrasive agent being sprinkled over the surface of the image carrier when the printer apparatus is in a state of rest.

7. An abrasive agent according to claim 6, wherein said abrasive powders are supplied to the image carrier while passing through the mesh.

8. An abrasive agent according to claim 6, wherein said abrasive powders are supplied to the image carrier while passing through the mesh, when the removing means is brought into initial contact with the image carrier.

9. An abrasive agent according to claim 6, wherein said abrasive powders are supplied to the image carrier while passing through the mesh, in a case where said image carrier is scratched during printing.

10. An abrasive agent according to claim 6, wherein said abrasive powders are supplied to the image carrier while passing through the mesh, when printing is effected by a predetermined number of times.

* * * * *